US011322060B2

(12) United States Patent
Park et al.

(10) Patent No.: US 11,322,060 B2
(45) Date of Patent: May 3, 2022

(54) DISPLAY DEVICE

(71) Applicant: LG Display Co., Ltd., Seoul (KR)

(72) Inventors: Kwangmo Park, Paju-si (KR); Suzy Ahn, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/110,091

(22) Filed: Dec. 2, 2020

(65) Prior Publication Data

US 2021/0183283 A1 Jun. 17, 2021

(30) Foreign Application Priority Data

Dec. 11, 2019 (KR) ..... 10-2019-0165054

(51) Int. Cl.
*G09G 3/3291* (2016.01)
*G09G 3/00* (2006.01)
*G09G 3/3266* (2016.01)

(52) U.S. Cl.
CPC ..... *G09G 3/006* (2013.01); *G09G 3/3266* (2013.01); *G09G 3/3291* (2013.01); *G09G 2310/08* (2013.01)

(58) Field of Classification Search
CPC .. G09G 3/3208; G09G 3/3225; G09G 3/3233; G09G 3/3266; G09G 3/3291; G09G 3/006; G09G 2230/00; G09G 2300/0426; G09G 2300/0452; G09G 2300/0819; G09G 2320/0295; G09G 2310/0278; G09G 2310/06; G09G 2310/08; G09G 2320/0233; G09G 2320/0285; G09G 2320/041; G09G 2320/043; G09G 2320/045; G09G 2320/0693; G09G 2330/12; G09G 2330/026; G09G 2330/027
See application file for complete search history.

(56) References Cited

U.S. PATENT DOCUMENTS

2013/0050292 A1* 2/2013 Mizukoshi ..... G09G 3/3291 345/690
2013/0169699 A1* 7/2013 Jeong ..... G09G 3/3225 345/690
2015/0123953 A1* 5/2015 Shim ..... G09G 3/3233 345/205
2015/0179105 A1* 6/2015 Mizukoshi ..... G09G 3/3233 345/76
2016/0351095 A1* 12/2016 Tani ..... G09G 3/3283
2017/0004765 A1* 1/2017 Tani ..... G09G 3/3233
2018/0182278 A1* 6/2018 Kim ..... G09G 3/3233

* cited by examiner

*Primary Examiner* — Michael J Eurice
(74) *Attorney, Agent, or Firm* — Fenwick & West LLP

(57) ABSTRACT

A display device is proposed, the display device including a display panel including a display panel including a plurality of unit pixels including at least two sub-pixels that share a data line and are connected to different gate lines, a driving circuit supplying a scan signal and a data voltage to first and second sub-pixels included in the unit pixel and connected to different data lines, a sensing unit connected to the first and second sub-pixels throughs a sensing line to sense operating characteristics of the first and second sub-pixels, and a timing controller controlling the driving circuit and the sensing unit to obtain sensing data corresponding to the operating characteristics and compensate the data voltage based on the sensing data.

10 Claims, 14 Drawing Sheets

DISPLAY DEVICE

CROSS-REFERENCE TO RELATED APPLICATIONS

The application claims the priority benefit of Republic of Korea Patent Application No. 10-2019-0165054 filed on Dec. 11, 2019, the entire contents of which is incorporated herein by reference in its entirety.

BACKGROUND

Field of Technology

The present disclosure relates generally to a display device and, more particularly, to a display device that detects a degradation characteristic of an OLED.

Description of the Related Art

A flat panel display device includes a liquid crystal display device (LCD), an electroluminescence display, a field emission display (FED), a quantum dot display panel (QD), and the like. The electroluminescent display device is divided into an inorganic light emitting display device and an organic light emitting display device according to the material of the light emitting layer. The pixels of the organic light emitting display device include an organic light emitting diode (OLED), which is a light emitting element that emits light by itself, to display an image by emitting the OLED.

The active matrix type organic light emitting display panel including an OLED has advantages of having high response speed, high luminous efficiency, and high brightness, and providing a wide viewing angle.

The organic light emitting display device has pixels including an OLED and a driving transistor arranged in a matrix form to adjust luminance of an image implemented in a pixel according to gradation of video data. The driving transistor controls driving current flowing through the OLED according to a voltage applied between its gate electrode and source electrode. An emission amount of the OLED is determined according to the driving current, and the luminance of the image is determined according to the emission amount of the OLED.

The electrical characteristic of the OLED and the driving transistor have a degradation phenomenon where luminous efficiency decreases as time passes by, and such degradation phenomenon may vary from pixel to pixel. Since such variation in degradation occurs for each pixel, even when image data of the same gradation is applied to pixels, the pixels emits light with different luminance from each other, whereby the image quality is degraded.

In order to compensate for the variation in characteristics between pixels, an external compensation technology, which measures sensing information corresponding to the electrical characteristics of the pixels (threshold voltage of the driving transistor, mobility of the driving transistor, threshold voltage or capacitance of the OLED), converts the same into digital sensing data thorough an analog-to-digital converter (ACD), and modulates the image data on the basis of the same, is known in the related art.

However, a compensation technology, in particular, an operation of sensing the degradation of the OLED in the related art is performed independently for each color. For example, in the case of a display panel in which a unit pixel is composed of four color sub-pixels, the first color sub-pixels are sensed for all display lines of the display panel, the second color sub-pixels are sensed for all display lines, the third color sub-pixels are sensed for all display lines, and then the fourth color sub-pixels are sensed for all display lines.

In general, an OLED capacitance sensing operation is performed in a screen idle state, that is, in a state that the system power is applied, but the screen is turned off. In addition, since the OLED emits light and then the OLED capacitance is sensed, the display line on which the OLED capacitance sensing operation is performed has no choice but to be perceived by the user's eyes.

However, since the number of display lines increases as the display device gradually increases in size and resolution, there is an increasing need to reduce the sensing time.

SUMMARY

The embodiments disclosed herein take this situation into consideration, and an objective of this disclosure is to provide a display device capable of reducing the overall sensing time that it takes to sense degradation of all OLEDs included in a display panel.

A display device according to an embodiment includes a display panel including a plurality of unit pixels having at least two sub-pixels that share a data line and are connected to different gate lines, a driving circuit supplying a scan signal and a data voltage to a first sub-pixel and a second sub-pixel included in a unit pixel of the plurality of unit pixels and connected to different data lines, a sensing unit connected to the first sub-pixel and the second sub-pixel through a sensing line to sense operating characteristics of the first sub-pixel and the second sub-pixel, and a timing controller controlling the driving circuit and the sensing unit to obtain sensing data corresponding to the operating characteristics and compensate the data voltage based on the sensing data, wherein the timing controller controls the driving circuit and the sensing unit so that a first sensing scan signal for sensing the operating characteristics of the first sub-pixel and a second sensing scan signal for sensing the operating characteristics of the second sub-pixel are supplied in a partial overlapping manner to sequentially obtain first sensing data and second sensing data corresponding to the operating characteristics of the first sub-pixel and the second sub-pixel.

According to a double rate driving (DRD) type pixel array, it is possible to perform sense driving that senses the OLED characteristics of two color sub-pixels in an overlapping manner, thereby reducing the time taken to sense the OLED characteristics of the entire display panel. In addition, it is possible to reduce a phenomenon that the display line performing the sensing operation while sensing the OLED characteristic is visible to a user by reducing the sensing time, thereby increasing the user satisfaction.

BRIEF DESCRIPTION OF THE DRAWINGS

The accompanying drawings, which are included to provide a further understanding of the disclosure and are incorporated in and constitute a part of this specification, illustrate embodiments of the disclosure and, together with the description, serve to explain the principles of the disclosure. In the drawings.

DETAILED DESCRIPTION

Hereinafter, preferred embodiments will be described in detail with reference to the accompanying drawings.

Throughout the specification, the same reference numbers refer to substantially the same components. In the following description, when it is determined that a detailed description of a known function or configuration related to the contents of this specification may unnecessarily obscure or interfere with the understanding of contents, the detailed description will be omitted.

Figure 1:
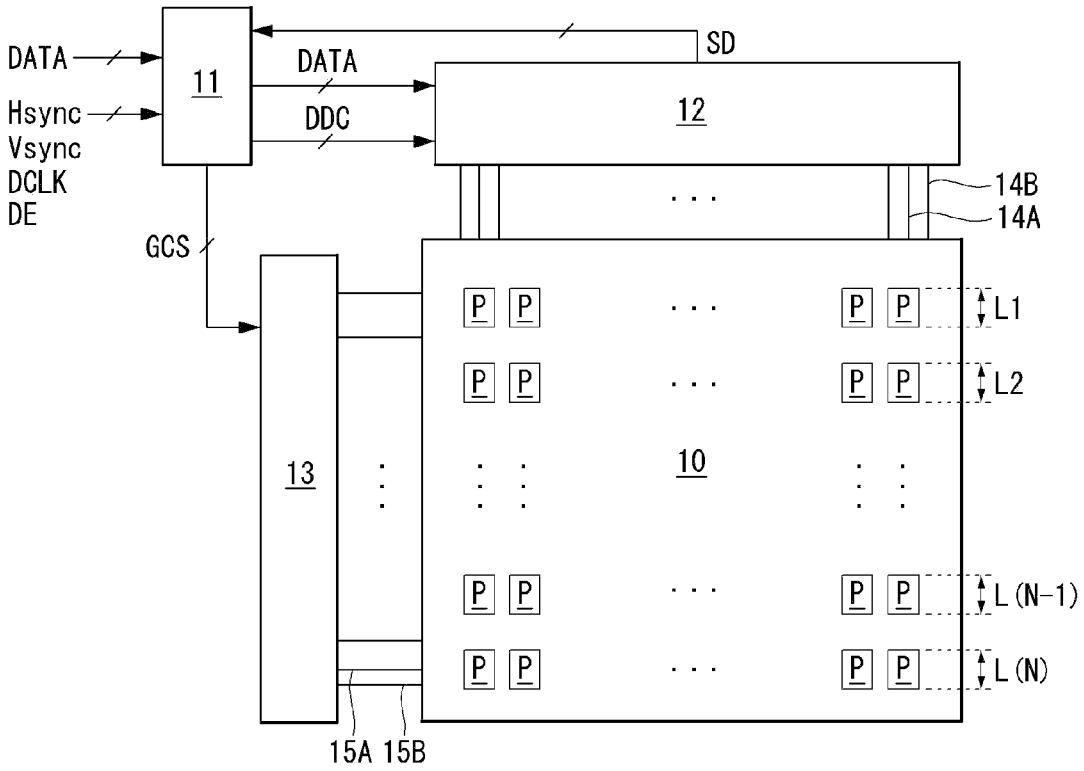
FIG. 1 is a functional block diagram illustrating an organic light emitting display device sensing an operating voltage of an OLED, according to an embodiment of the disclosure.
Figure 2:
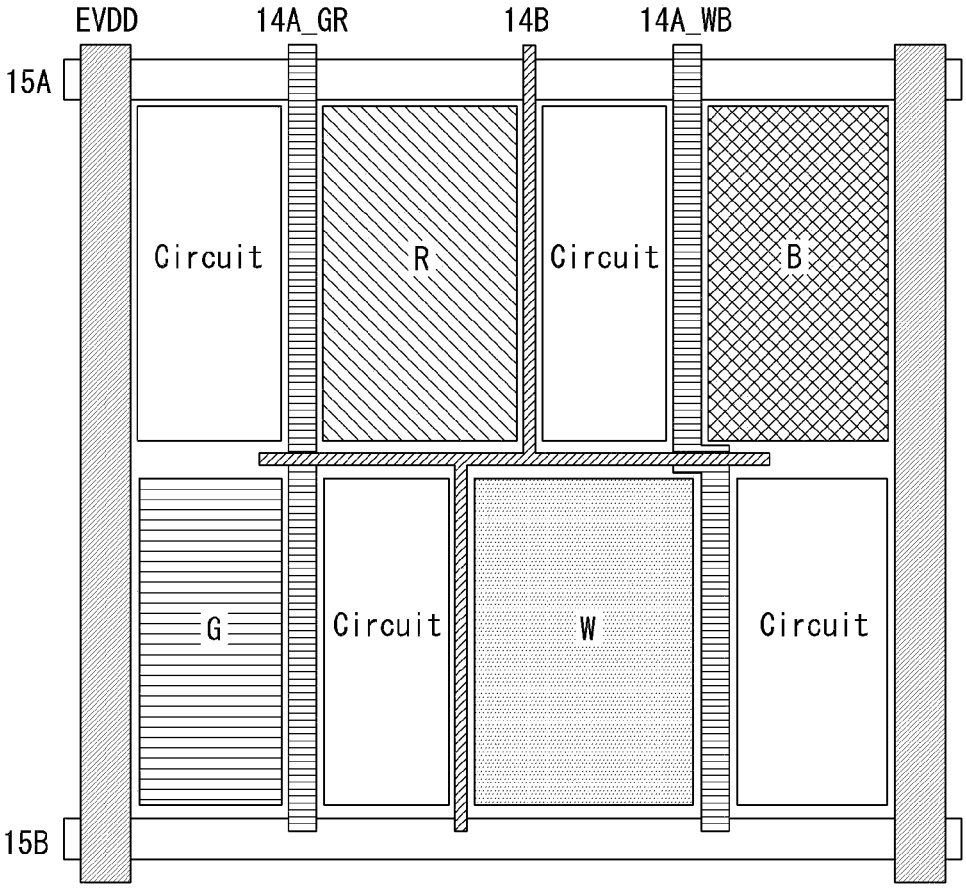
FIG. 2 is a view illustrating an actual arrangement of sub-pixels of a double rate driving (DRD) type pixel array in which two sub-pixels share a data line, according to an embodiment of the disclosure.
Figure 3A:
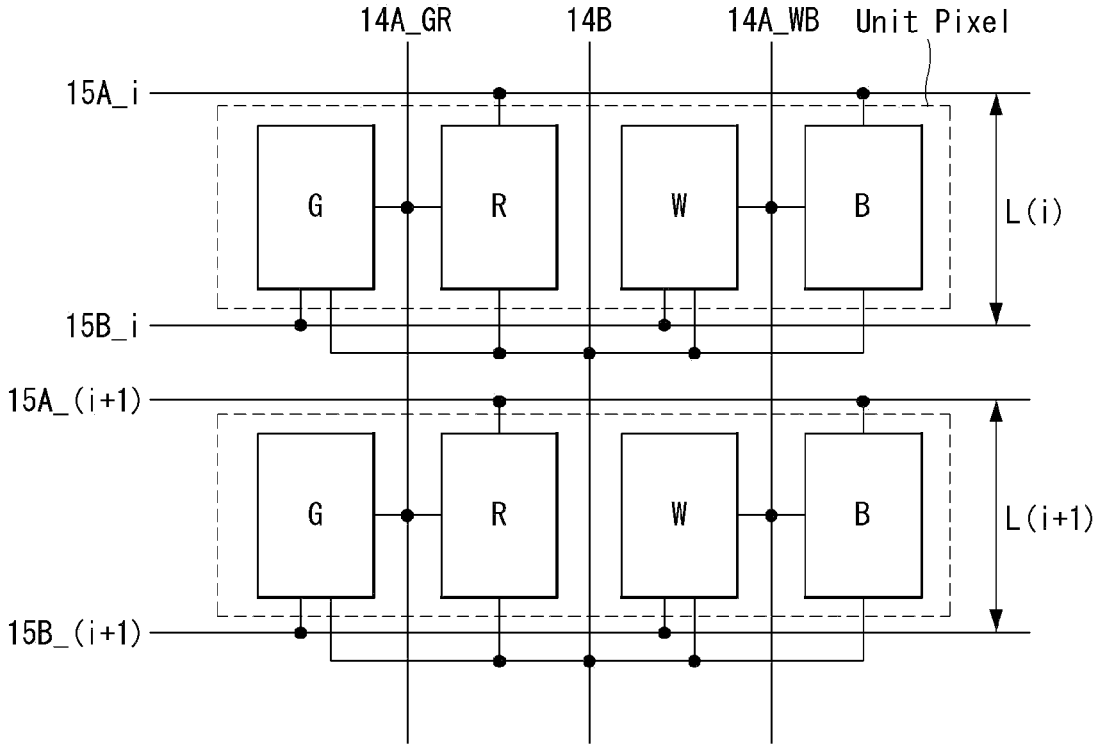
FIGS. 3A and 3B are views illustrating the connection of sub-pixels, data lines, gate lines, and sensing lines in a DRD type pixel array, according to an embodiment of the disclosure.
Figure 3B:
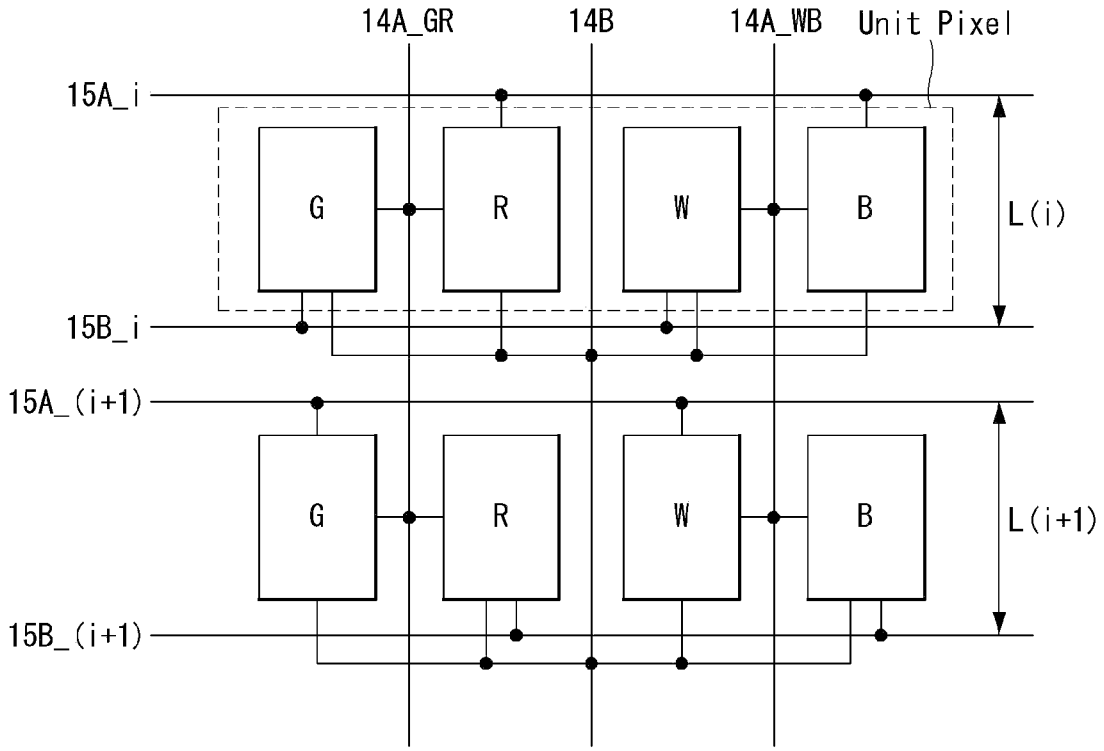

FIG. 1 is a functional block diagram illustrating an organic light emitting display device sensing an operating voltage of an OLED, according to an embodiment of the disclosure. FIG. 2 is a view illustrating an actual arrangement of sub-pixels of a double rate driving (DRD) type pixel array in which two sub-pixels share a data line, according to an embodiment of the disclosure. FIGS. 3A and 3B are views illustrating the connection of sub-pixels, data lines, gate lines, and sensing lines in a DRD type pixel array, according to an embodiment of the disclosure.

An organic light emitting display device provided to implement external compensation for sensing an operating voltage of an OLED for the purpose of compensation may include a display panel 10, a timing controller 11, a data driving circuit 12, and a gate driving circuit 13.

All or some of the timing controller 11, the data driving circuit 12 and the gate driving circuit 13 in FIG. 1 may be integrated into a drive IC, and the data driving circuit 12 and the gate driving circuit 13 are combined to be configured as a single driving circuit.

On a screen where an input image is displayed in the display panel 10, a plurality of data lines 14A and sensing lines 14B arranged in a column direction (or vertical direction) and a plurality of gate lines 15 arranged in a row direction (or horizontal direction) intersect with each other, and pixels P are arranged in a matrix form for each intersection area, thereby forming a pixel array.

The gate lines 15A and 15B supply, to the pixels P, scan signals which are to apply the data voltage supplied to the data line 14A to the pixel P, to apply the initialization voltage supplied to the sensing line 14B to the pixel P, and to apply the characteristic signal of the pixel P to the data driving circuit 12 through the sensing line 14B.

As shown in FIGS. 2 and 3, a unit pixel serving as a reference for resolution may be composed of an R sub-pixel for a red color, a G sub-pixel for a green color, a B sub-pixel for a blue color, and a W sub-pixel for a white color.

In order to reduce the number of source drives ICs constituting the data driving circuit 12 or the number of output channels output by the source drive IC, four sub-pixels constituting a unit pixel may be arranged in a double rate drive (DRD) type in which two neighboring sub-pixels share one data line in a horizontal direction, as illustrated in FIG. 2.

In FIG. 2, the G sub-pixel and the R sub-pixel share a first data line 14A_GR, and the W sub-pixel and the B sub-pixel share a second data line 14A_WB. In addition, for symmetry, circuit units and openings (or light emitting units) of the neighboring sub-pixels are alternately arranged with each other, thereby preventing the leakage of light, and accordingly, the R sub-pixel and the B sub-pixel are connected to a first gate line 15A passing over the pixel unit, and the G sub-pixel and W sub-pixel are connected to a second gate line 15B passing under the pixel unit.

In addition, the G sub-pixel and the B sub-pixel having relatively smaller light emitting regions than the R sub-pixel and the W sub-pixel are disposed next to the first power supply line EVDD supplying a high potential power voltage, thereby preventing the first data line 14A_GR and the second data line 14A_WB from being bent while changing the direction as the display line advances.

The sensing line 14B for supplying the initialization voltage to the pixel and sensing the characteristics of the pixel may be arranged to pass the center of the unit pixel and advance in parallel with the first/second data line 14A_GR and 14A_WB. The G/R/W/B sub-pixels constituting the unit pixel may be commonly connected to one sensing line 14B.

In FIG. 3A, the connection between the sub-pixels and the data line 14A, the first/second gate lines 15A and 15B, and the sensing line 14B is the same to each other in the i-th display line L(i) and (i+1)-th display line L(i+1). However, in FIG. 3B, the connection between the sub-pixels and the data line 14A, the first/second gate lines 15A and 15B, and the sensing line 14B is different from each other in the i-th display line L(i) and (i+1)-th display line L(i+1).

When the pixel array is configured as shown in FIG. 3B, when the data voltage is supplied to the pixels of two neighboring display lines through the data line 14A, the data voltage is supplied to sub-pixels of the same color twice in a continuous manner. Since the image data of the neighboring sub-pixels of the same color is likely to be similar, there is little difference in data voltage, whereby the source drive IC can easily to drive (charge) the data line 14A, which results in an advantage of reducing power consumption.

Meanwhile, since the arrangement of sub-pixels in the unit pixel is symmetrical with respect to the horizontal direction in which the gate line 15 advances, there is a disadvantage in that display panel manufacturing is more complicated, and the arrangement of sub-pixels is not uniform overall and has a uniform pattern.

The arrangement of FIG. 3A is opposite the arrangement of FIG. 3B in advantages and disadvantages.

In the following specification, although embodiments will be described referring to FIG. 3A, the embodiments may be applied to FIG. 3B under the same context without significant change. Hereinafter, in the description related to the operation of the pixel, the pixel may mean a sub-pixel.

The display panel 100 may further include a first power supply line EVDD for supplying a high potential power voltage (or a pixel driving voltage) to the pixels Ps and, a second power line EVSS for supplying a low potential power voltage to the pixels Ps, and the like. The first/second power lines are connected to a power supply unit (not shown). The second power line may be formed in the form of a transparent electrode covering a plurality of pixels Ps.

Touch sensors may be disposed on the pixel array of the display panel 10. The touch input may be detected using separate touch sensors or may be detected through the pixels. The touch sensors may be placed on a screen AA of the display panel 10 in an on-cell type or an add-on type, or implemented with in-cell type touch sensors embedded in the pixel array.

In the pixel array, the pixels Ps arranged on the same horizontal line are connected to any one of the data lines 14A and any one of the gate lines 15A, 15B, thereby forming a pixel line (or display line) L(i).

The pixel P is electrically connected to the data line 14A in response to a scan signal applied through the gate lines 15A and 15B to receive a data voltage and emit the OLED with an electric current corresponding to the data voltage.

Pixels connected to the same gate line 15A or 15B, among the pixels Ps connected to the same pixel line, operate simultaneously according to the scan signal applied from the corresponding gate line.

The pixel P is supplied with a high potential power voltage EVDD and a low potential power voltage EVSS from a power supply unit (not shown). The pixel P may have a circuit structure suitable for sensing degradation of the OLED, which is a light emitting device, according to an elapsed driving time and/or environmental conditions such as panel temperature. The circuit configuration of the pixel P may be variously modified. For example, the pixel P may include a plurality of switch elements and at least one storage capacitor, in addition to the light emitting element and the driving element.

The power supply unit adjusts a DC input voltage provided from the host by using a DC-DC converter, to generate a gate-on voltage and a gate-off voltage, which are required for operation of the data driving circuit 12 and the gate driving circuit 13, and to generate a high potential power voltage EVDD and a low potential power voltage VSS, which are required for driving the pixel array.

The host system may be an application processor AP in a mobile device, a wearable device, and a virtual/augmented reality device. Alternatively, the host system may be a main board such as a television system, a set top box, a navigation system, a personal computer, and a home theater system, but is not limited thereto.

The timing controller 11 may temporally separate sense driving and display driving according to a predetermined control sequence. Here, the sense driving is performed for sensing the capacitance of the light emitting element and updating a compensation value according to the same, and the display driving is performed for writing image data DATA reflecting the compensation value to the display panel 10 to reproduce an image.

Under the control of the timing controller 11, the sense driving may be performed in a power-on sequence before the display driving starts or in a power-off sequence after the display driving ends. The power-on sequence refers to a period during which an operation is performed from after the system power is applied until the screen is turned on, and the power-off sequence refers to a period during which the operation is performed from after the screen is turned off until the system power is interrupted.

The sense driving may be performed in a state in which only the screen of the display device is turned off while the system power is being applied, for example, a standby mode, a sleep mode, a low power mode, and the like. The timing controller 11 may detect a standby mode, a sleep mode, a low power mode, etc. according to a predetermined sensing process, and control operations required for the sense driving.

The timing controller 11 supplies image data DATA transmitted from the host system to the data driving circuit 12. The timing controller 11 receives timing signals such as a vertical synchronization signal Vsync, a horizontal synchronization signal Hsync, a data enable signal DE, and a dot clock DCLK from the host system, and generates control signals for controlling the operation timing of the data driving circuit 12 and the gate driving circuit 13. The control signals include a gate control signal GCS for controlling the operation timing of the gate driving circuit 13 and a data control signal DDC for controlling the operation timing of the data driving circuit 12.

The timing controller 11 may generate control signals DDC and GCS for the display driving and control signals DDC and GCS for the sense driving, in such a manner as to be different from each other.

The timing controller 11 receives sensing data SD for the capacitance of the light emitting device at the time of the sense driving, from the data driving circuit 12, and calculates a compensation value capable of compensating for a variation in luminance according to degradation of the light emitting device (that is, a change in capacitance) on the basis of the sensing data SD, to be stored in a memory (not shown). Since the compensation value stored in the memory may be updated whenever the sense driving is repeated, it is possible to easily compensate the variation in characteristics of the light emitting device that changes as time passes by.

The timing controller 11 reads the compensation value from the memory at the time of the display driving, and corrects the input image data DATA on the basis of the compensation value to be supplied to the data driving circuit 12.

Figure 4:
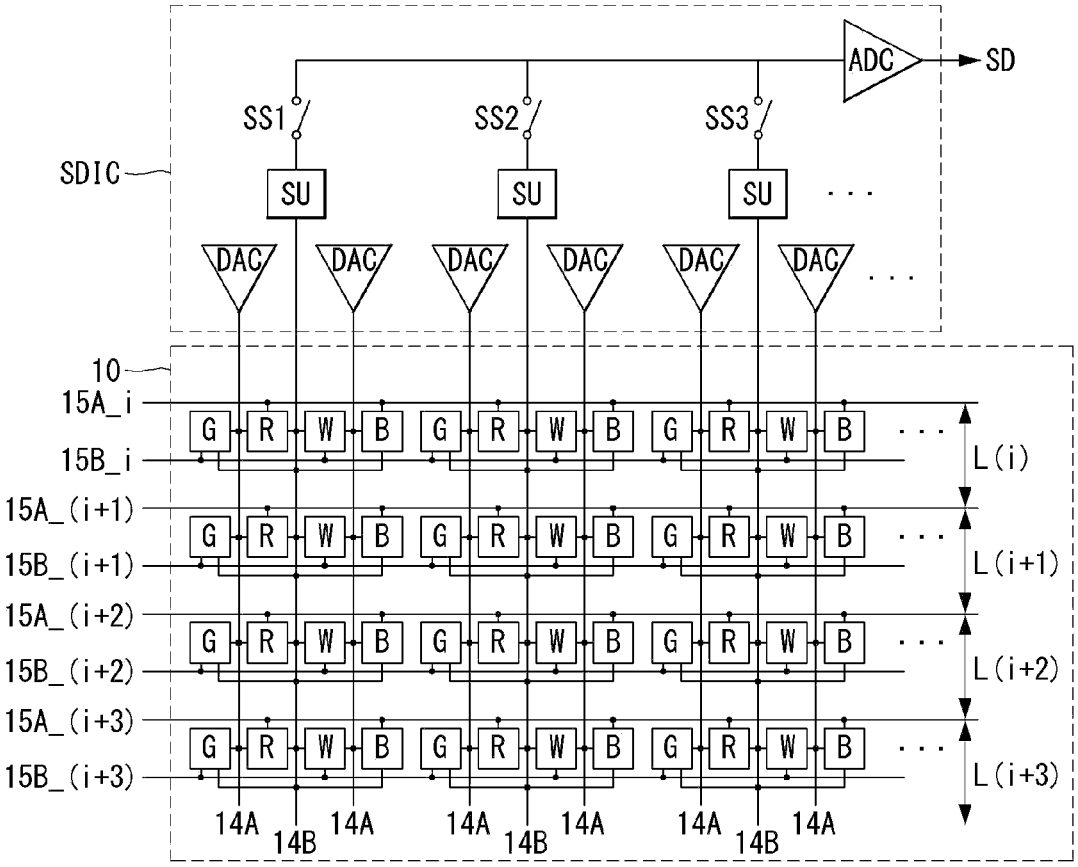
FIG. 4 is a view illustrating a configuration of a pixel array and a source drive IC, according to an embodiment of the disclosure.

FIG. 4 is a view illustrating the configuration of a pixel array and a source drive IC, according to an embodiment of the disclosure.

The data driving circuit 12 may include at least one source drive IC SDIC. The source drive IC SDIC includes a plurality of data drivers connected to the data line 14A.

When performing the display driving, the data driver of the source drive IC samples and latches the digital video data DATA input from the timing controller 11 on the basis of the data control signal DDC, to be converted into parallel data, converts the latched digital data to an analog data voltage according to a gamma initialization voltage through a digital-to-analog converter DAC, and supplies the data voltage to the pixels Ps through the output channel and the data lines 14A. The data voltage may be a value corresponding to gradation to be represented by a pixel.

When performing the sense driving, the data driver may generate a sensing data voltage according to the data control signal DDC to be supplied to the data lines 14A.

The sensing data voltage may include an on-driving data voltage and an off-driving data voltage. The on-driving data voltage is applied to the gate electrode of the driving device to turn on the driving device (i.e., a voltage for setting the pixel current), and the off-driving data voltage is applied to the gate electrode of the driving element to turn off the driving element (i.e., a voltage for blocking the pixel current).

The on-driving data voltage is applied to a sub-pixel to be sensed in a unit pixel, and the off-driving data voltage is applied to non-sensing pixels sharing the sensing line 14B together with the sensing pixel in the unit pixel. For example, in FIG. 3A, when an R sub-pixel and a W sub-pixel are sensed, and a G sub-pixel and a B sub-pixel are not sensed, the on-driving data voltage may be applied to driving elements of the R and W sub-pixels, and the off-driving data voltage may be applied to driving elements of the G and B pixels.

The on-driving data voltage and the off-driving data voltage are applied to the sensing pixel. Herein, the on-driving data voltage is supplied during a period of setting the pixel current in the sensing pixel, and the off-driving data voltage may be supplied during a period of sampling the capacitance of the light emitting device in the sensing pixel.

Meanwhile, the source drive IC SDIC includes a plurality of sensing units SUs connected to the sensing line 14B and an analog-to-digital converter ADC converting the sensing voltage sensed by the sensing unit SU into sensing data, in which the sensing unit SU and the analog-to-digital converter ADC may be referred to as a sensing unit.

Each sensing unit SU is connected to the sensing line 14B and may be selectively connected to the analog-to-digital converter ADC through switches SS1 to SSk. Each sensing unit SU may be implemented as a current-to-voltage converter such as a current integrator or current comparator. Since each sensing unit SU is implemented in a current sensing manner, the sensing unit SU is suitable for low current sensing and high speed sensing. That is, when each sensing unit SU is configured in a current sensing manner, it is advantageous to reduce the sensing time and increase the sensing sensitivity.

The analog-to-digital converter ADC may convert the sensing voltage input from each sensing unit SU to sensing data SD and output the same to the timing controller 11.

The gate driving circuit 13 may be configured with a plurality of gate drive integrated circuits that each includes a shift register, a level shifter for converting the output signal of the shift register to a swing width suitable for driving a transistor included in the pixel, an output buffer, etc. Alternatively, the gate driving circuit 13 may be directly formed on a lower substrate of the display panel 10 by a gate drive IC in panel (GIP) method. In the case of the GIP method, the level shifter is mounted on a printed circuit board (PCB), and the shift register may be formed on the lower substrate of the display panel 10. The scan signal swings between the gate on voltage and the gate off voltage.

The gate driving circuit 13 generates a display scan signal in a row sequential manner on the basis of the gate control signal GCS during the display driving, and sequentially provides the same to the gate lines 15A and 15B connected to each pixel line. The display scan signal is supplied to the gate lines 15A and 15B in synchronization with the supply of the data voltage of the data line 14A.

The gate driving circuit 13 may generate a sensing scan signal on the basis of the gate control signal GCS and provide the same to the gate lines 15A and 15B during the sense driving. The sensing scan signal is synchronized with the sensing data voltage supplied to the data line 14A.

When performing the sense driving, the gate driving circuit 13 supplies overlapping sensing scan signals to two sub-pixels that do not share a data line through the first gate line 15A and the second gate line 15B in a pixel structure in which two sub-pixels included in a unit pixel share a data line 14A in a DRD manner and are connected to different gate lines 15A and 15B, thereby sensing the characteristics of the light emitting elements of two color sub-pixels on the same display line in an overlapping manner.

In synchronization with the first sensing scan signal supplied to the first gate line 15A connected to the first sub-pixel among two sub-pixels that do not share the data line, the on-driving data voltage and the off-driving data voltage are supplied to the first data line 14A_GR to which the first sub-pixel is connected. In addition, the second sensing scan signal is supplied to the second gate line 15B connected to the second sub-pixel, later than the first sensing scan signal by a predetermined time, and the on-driving data voltage and the off-driving data voltage may be supplied to the second data line 14A_WB connected to the second sub-pixel in synchronization with the second sensing scan signal.

The timing controller 11 simultaneously senses two colors sharing the data line 14A on a per-display line basis, when performing a sense driving sequence for sensing the characteristics of the light emitting element included in the pixel by controlling the sensing unit SU of the gate driving circuit 13 and the data driving circuit 12. Herein, the sensing operation is performed for all display lines while changing the display line in a line sequential manner, and the other two colors are sensed simultaneously on a per-display line basis in the same way, whereby the sensing operation may be performed on all display lines in a line sequential manner.

Figure 5:
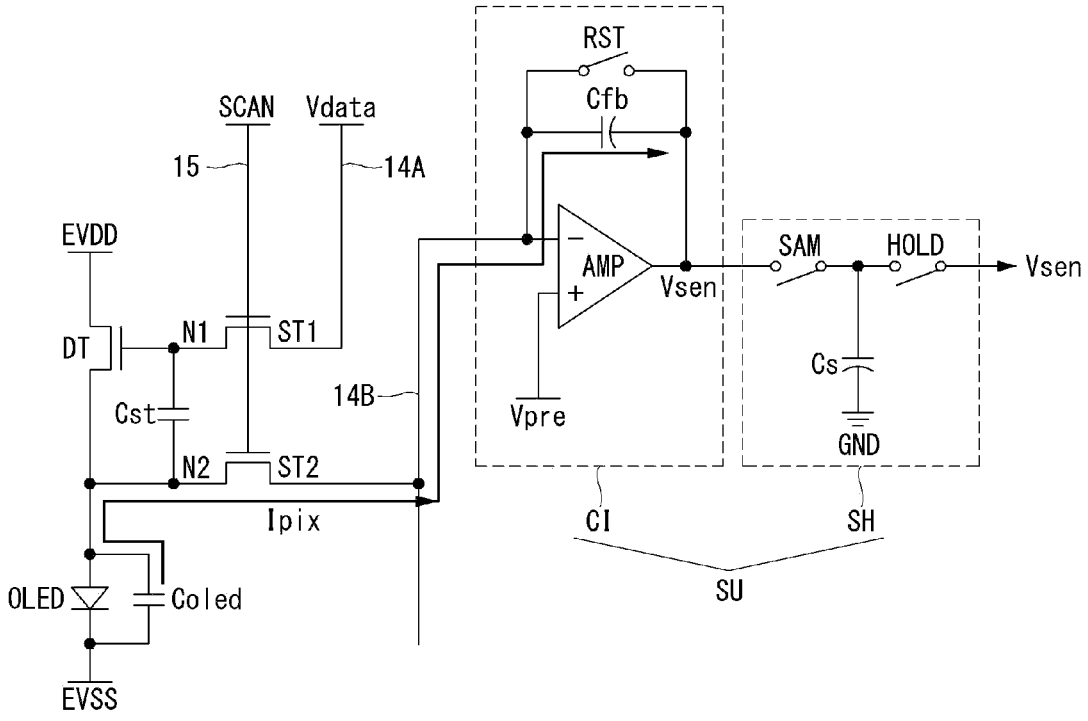
FIG. 5 is a view illustrating a configuration of a pixel circuit and a sensing unit, according to an embodiment of the disclosure.

FIG. 5 is a view illustrating the configuration of a pixel circuit and a sensing unit, according to an embodiment of the disclosure.

Each pixel P includes an OLED which is a light emitting element, a driving thin film transistor DT which is a driving element, a storage capacitor Cst, a first switching TFT ST1, and a second switching TFT ST2. The TFTs constituting the pixel P may be implemented in p-type, or implemented in a n-type, or implemented in a hybrid type in which p-type and n-type are mixed. In addition, the semiconductor layer of TFTs constituting the pixel P may include amorphous silicon, polysilicon, or oxide.

The OLED emits light according to the pixel current generated by the driving TFT. The OLED includes an anode electrode connected to the second node N2, a cathode electrode connected to an input terminal of the low potential power supply voltage EVSS, and an organic compound layer positioned between the anode electrode and the cathode electrode.

A parasitic capacitor Coled exists in the OLED by the anode electrode, the cathode electrode, and a plurality of insulating films between them. The capacitance of the parasitic capacitor Coled of the OLED is several pF, which is very small, compared to hundreds to thousands of pF which is the capacitance of the parasitic capacitor existing in the sensing line 14B.

The degradation of the OLED may be sensed through a current sensing method using the parasitic capacitor Coled of the OLED. The current sensing method may reduce the sensing time and increase the sensing accuracy, compared to a voltage sensing method sensing a voltage charged in the sensing line 14B. That is, when the electric charge (corresponding to the OLED operating point voltage) accumulated in the parasitic capacitor Coled of the OLED is sensed through current sensing, it is advantageous to achieve low-current sensing and high-speed sensing.

The driving TFT DT controls the pixel current input to the OLED according to a gate-source voltage Vgs. The driving TFT DT has a gate electrode connected to the first node N1, a drain electrode connected to an input terminal of a high potential power supply voltage EVDD, and a source electrode connected to the second node N2.

The storage capacitor Cst is connected between the first node N1 and the second node N2.

The first switching TFT ST1 applies a data voltage Vdata supplied to the data line 14A to the first node N1 in response to the scan signal SCAN. The data voltage Vdata is a voltage corresponding to input image data during the display driving and includes the on-driving data voltage and the off-driving data voltage as the sensing data voltage during the sense driving.

The first switching TFT ST1 has a gate electrode connected to the gate line 15, a drain electrode connected to the data line 14A, and a source electrode connected to the first node N1. The second switching TFT ST2 switches a current flow between the second node N2 and the sensing line 14B in response to the scan signal SCAN. The second switching TFT ST2 has a gate electrode connected to the gate line 15, a drain electrode connected to the sensing line 14B, and a source electrode connected to the second node N2.

The sensing unit SU is connected to the pixel P through the sensing line 14B. The sensing unit SU may include a current integrator CI and a sample & hold unit SH.

The current integrator CI integrates a current signal Ipix flowing from the pixel P to output a sensing voltage Vsen. The current signal Ipix depends on the amount of charge accumulated in the parasitic capacitor Coled of the OLED, and increases in proportion to the capacitance of the parasitic capacitor Coled of the OLED. The current integrator CI outputting the sensing voltage Vsen through the output terminal includes an amplifier AMP, a feedback capacitor Cfb connected between an output terminal and an inverting input terminal (−) of the amplifier AMP, and a reset switch RST connected to both ends of feedback capacitor Cfb.

The inverting input terminal (−) of the amplifier AMP applies an initialization voltage Vpre to the second node N2 through the sensing line 14B, and receives electric charge charged in the parasitic capacitor Coled of the OLED in the pixel P through the sensing line 14B. An initialization voltage Vpre is input to a non-inverting input terminal (+) of the amplifier AMP.

The current integrator CI is connected to the analog-to-digital converter ADC through the sample & hold unit SH. The sample & hold unit (SH) may include a sampling switch SAM that samples a sensing voltage Vsen output from the amplifier AMP and stores the same in the sampling capacitor Cs and a holding switch HOLD that transfers the sensing voltage Vsen stored in the sampling capacitor C to the analog-to-digital converter ADC.

Figure 6:
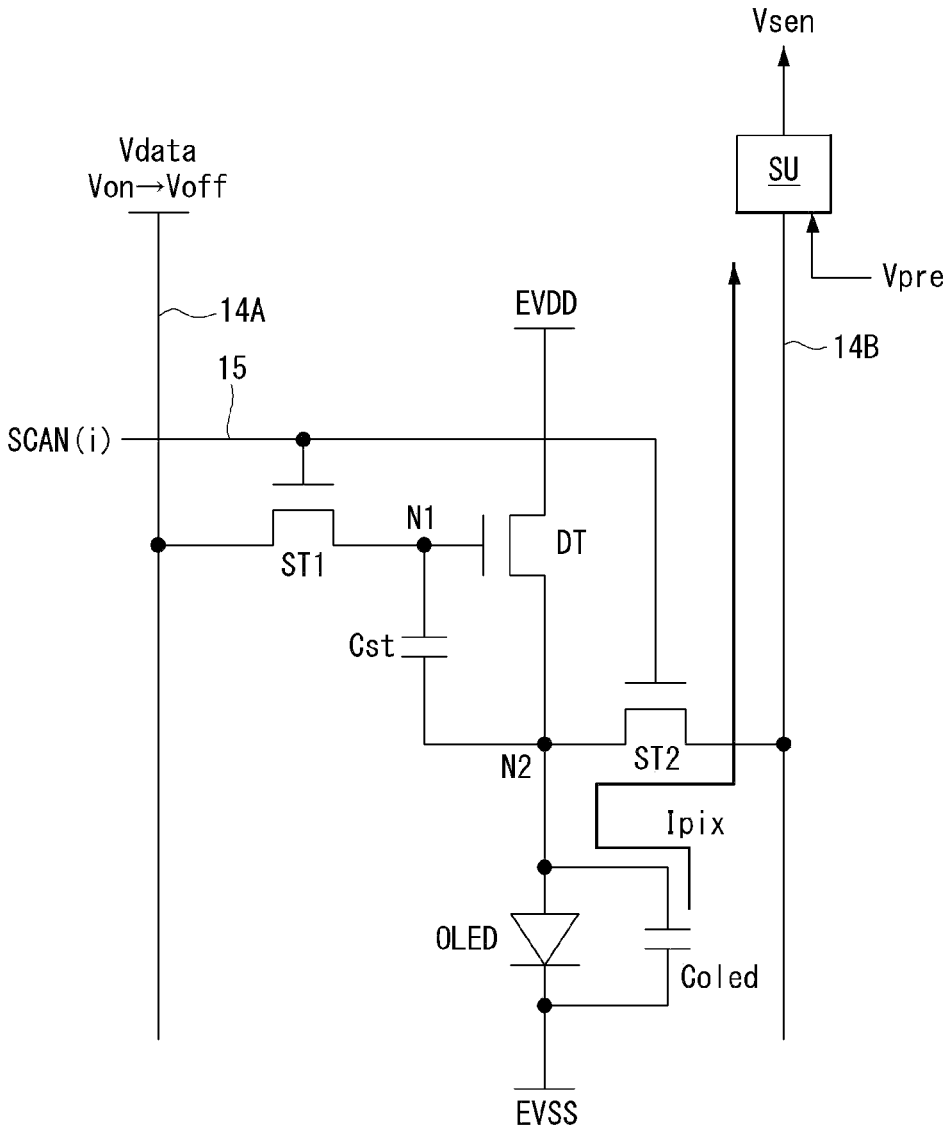
FIG. 6 is a view illustrating an operation of a pixel and a sensing unit when sensing a parasitic capacitance of an OLED, according to an embodiment of the disclosure.
Figure 7:
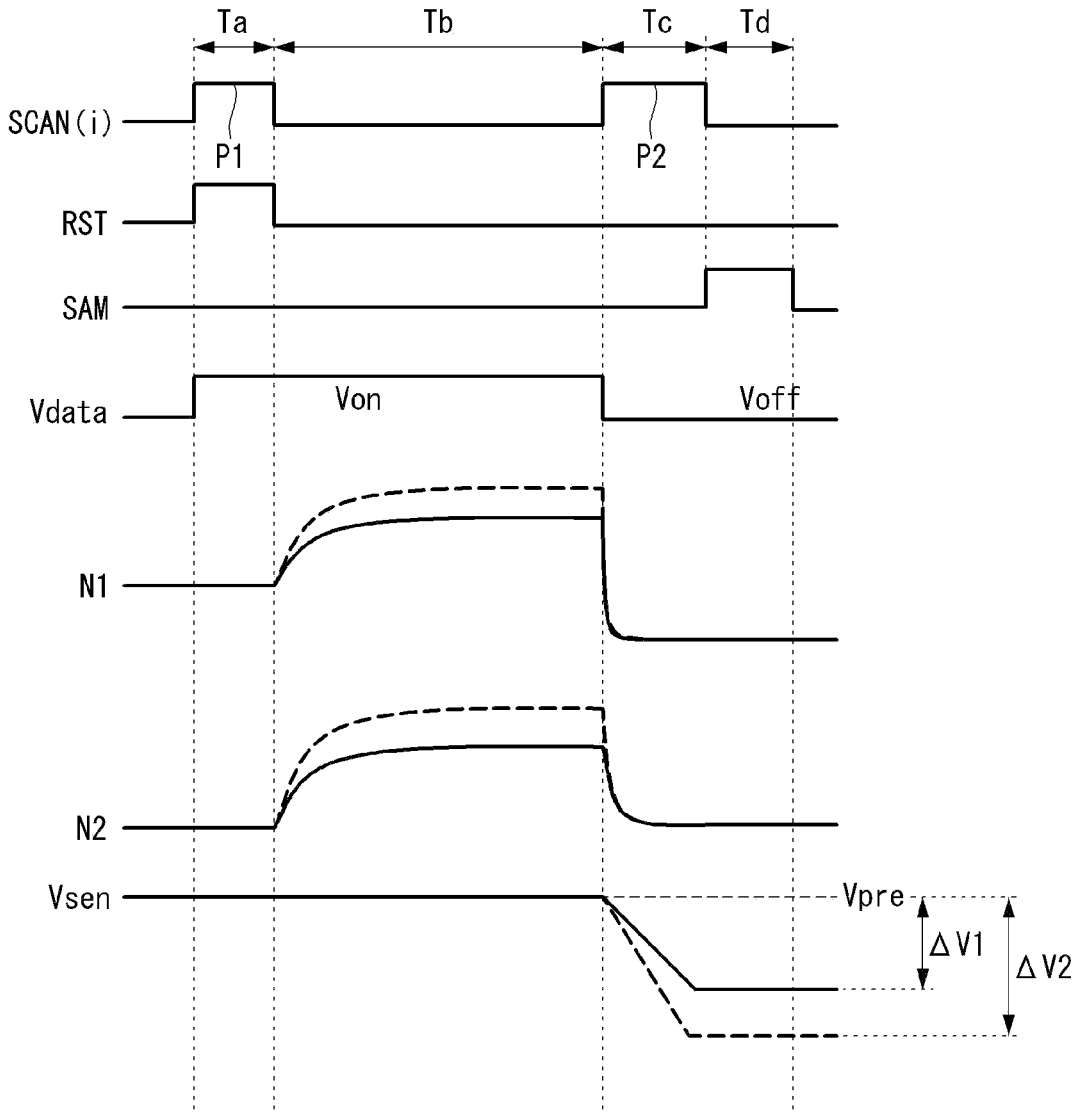
FIG. 7 is a view illustrating a control signal and a voltage of a main node when sensing a parasitic capacitance of an OLED, according to an embodiment of the disclosure.

FIG. 6 is a view illustrating the operation of a pixel and a sensing unit when sensing the parasitic capacitance of the OLED, according to an embodiment of the disclosure. FIG. 7 is a view illustrating a control signal and a voltage of a main node when sensing parasitic capacitance of an OLED, according to an embodiment of the disclosure.

The sense driving sequence for sensing the parasitic capacitance of the OLED may proceed in the order of an initialization period Ta, a boosting period Tb, and a sampling period Tc. For reference, the high-potential power voltage EVDD supplied to the pixel during the sense driving may be changed to a lower voltage than during the display driving, for example, from 24V to 10V.

In the initialization period Ta, the reset switch RST is turned on so that the current integrator CI operates as a unit gain buffer having a gain of 1, so that input terminals (+ and −) and an output terminal of the amplifier AMP and the sensing lines 14B are all initialized to an initialization voltage Vpre.

In the initialization period Ta, an on-driving data voltage Von is applied to the data line 14A. In addition, a first on-level scan pulse P1 is applied to a sensing scan signal SCAN in synchronization with the on-driving data voltage Von, thereby allowing the first switching TFT ST1 and the second switching TFT ST2 to be turned on.

In the initialization period Ta, the first switching TFT ST1 is turned on so that the on-driving data voltage Von supplied to the data line 14A is applied to the first node N1. Then, the second switching TFT ST2 is turned on so that the initialization voltage Vpre supplied to the sensing line 14B is applied to the second node N2. As a result, a voltage between a gate and a source of the driving TFT DT is set to allow the pixel current to flow.

In the boosting period Tb, the first and second switching TFTs ST1 and ST2 are turned off according to an off-level sensing scan signal SCAN. Herein, a potential of the second node N2, that is, an anode potential of an anode electrode of the OLED, rises to an operating point voltage of the OLED to be saturated by the pixel current flowing between a source and a drain of the driving TFT DT. When the anode potential of the OLED rises to the operating point voltage, the pixel current flows through the OLED so that the OLED emits light.

Herein, the parasitic capacitor Coled of the OLED is charged with the amount of charge corresponding to the operating point voltage of the OLED. Although the operating point voltage of the OLED is constant regardless of the degradation of the OLED, the capacitance of the parasitic capacitor Coled of the OLED increases due to deterioration, and thus the amount of charge charged in the parasitic capacitor Coled of the OLED also increases in proportion to the degradation (Q=Coled*Vanode).

Meanwhile, when the reset switch RST is turned on in the boosting period Tb (dashed line in FIG. 7), the current integrator CI always operates as a buffer having a gain of 1, so the sensing voltage Vsen is output as the initialization voltage Vpre in the boosting period Tb. Even when the reset switch RST is turned off in the boosting period Tb, the input and output of the amplifier AMP does not change, and thus the sensing voltage Vsen maintains the initialization voltage Vpre. That is, the control signal RST of the reset switch may be either a turn-on level or a turn-off level in the boosting period Tb.

FIG. 7 shows that an on-driving data voltage Von is supplied to the data line 14A in the boosting period Tb. However, in the boosting period Tb, since the first switching TFT ST1 is turned off, there is no problem even when the off-driving data voltage Voff is supplied to the data line 14A.

In the integration period Tc, the first and second switching TFTs ST1 and ST2 are turned on according to a second pulse P2 of the sensing scan signal SCAN having an on level, and the reset switch RST is turned off. Herein, the off-driving data voltage Voff is applied to the data line 14A in synchronization with the second pulse P2 of the sensing scan signal SCAN. The driving TFT DT is turned off according to an off-driving data voltage Voff applied through the first switching TFT ST1. Therefore, the pixel current applied to the OLED is cut off.

That is, in the integration period Tc, the pixel current is cut off and the charge charged in the parasitic capacitor Coled of the OLED is sensed. The charge charged in the parasitic capacitor Coled of the OLED moves to a feedback capacitor Cfb of the current integrator CI in the integration period Tc. As a result, a potential of the second node N2 drops from the boosting level to the initialization voltage Vpre.

In the integration period Tc, a potential difference between both ends of the feedback capacitor Cfb by the charge flowing into the inverting input terminal (−) of the amplifier AMP increases as the sensing time passes by, that is, as the amount of accumulated charge increases. However, since the inverting input terminal (−) and the non-inverting input terminal (+) of the amplifier (AMP) due to the nature thereof are short-circuited through a virtual ground to have a potential difference of zero, a potential of the inverting input terminal (−) maintains the initialization voltage Vpre regardless of an increase in the potential difference of the feedback capacitor Cfb in the integration period Tc. Instead, the potential of the output terminal of the amplifier AMP is lowered in response to the potential difference between both ends of the feedback capacitor Cfb.

According to this principle, the charge flowing through the sensing line 14B is changed to the integral voltage Vsen through the feedback capacitor Cfb in the integration period Tc, in which the sensing voltage Vsen may be output to be lower than the initialization voltage Vpre. This is due to the input/output characteristics of the current integrator CI. The larger the potential difference between the boosting level and the initialization voltages Vpre, that is, the larger the parasitic capacitance of the OLED, the greater a potential difference ΔV1 or ΔV2 between the initialization voltages Vpre and the sensing voltages Vsen.

In FIG. 7, a dotted line is an operating waveform of a pixel having a relatively large parasitic capacitance of the OLED, and a solid line is an operating waveform of a pixel having a relatively small parasitic capacitance of the OLED.

In the sampling period Td, the sampling switch SAM is turned on, so that the sensing voltage Vsen is stored in the sampling capacitor Cs. Thereafter, when the holding switch HOLD is turned on, the sensing voltage Vsen stored in the sampling capacitor Cs is input to the analog-to-digital converter ADC via the holding switch HOLD. The sensing voltage Vsen is converted to sensing data SD in the analog-to-digital converter ADC to be output to the timing controller 11.

According to the sense driving sequence, pixels arranged on each display line may be sensed.

In FIG. 7, the sensing scan signal for sensing the capacitance of the OLED may be composed of a turn-on level pulse (first pulse P1) in the initialization period Ta, a turn-off level in the boosting period Tb, a turn-on level pulse (second pulse P2) in the integration period Tc, and a turn-off level in the sampling period Td Meanwhile, when the parasitic capacitance of the OLED is sensed by the current sensing method, a lot of random noise is generated in the sensing signal. Herein, there is much room for noise to enter the sensing line 14B extending across the display panel 10, and a lot of noise intrudes from the analog-to-digital converter ADC after the sensing unit SU.

In the case that a noise occurs in the sensing data SD, a variation occurs in the sensing data when sensing the same sub-pixel. When the data voltage is compensated on the basis of the sensed data having a noise, the noise component may appear in the form of blobs in the image, which may be perceived by a user's eyes.

In order to reduce noise occurring in the sensing voltage Vsen or the sensing data SD, by obtaining the sensing data, multiple times, for example, 16, 32, or 64 times, and then averaging the same for the same sub-pixel, thereby reducing a variation in the sensing data due to noise.

However, when performing the sensing operation several times in a repetitive manner for the same sub-pixel, the time required for the sensing is greatly increased.

Figure 8:
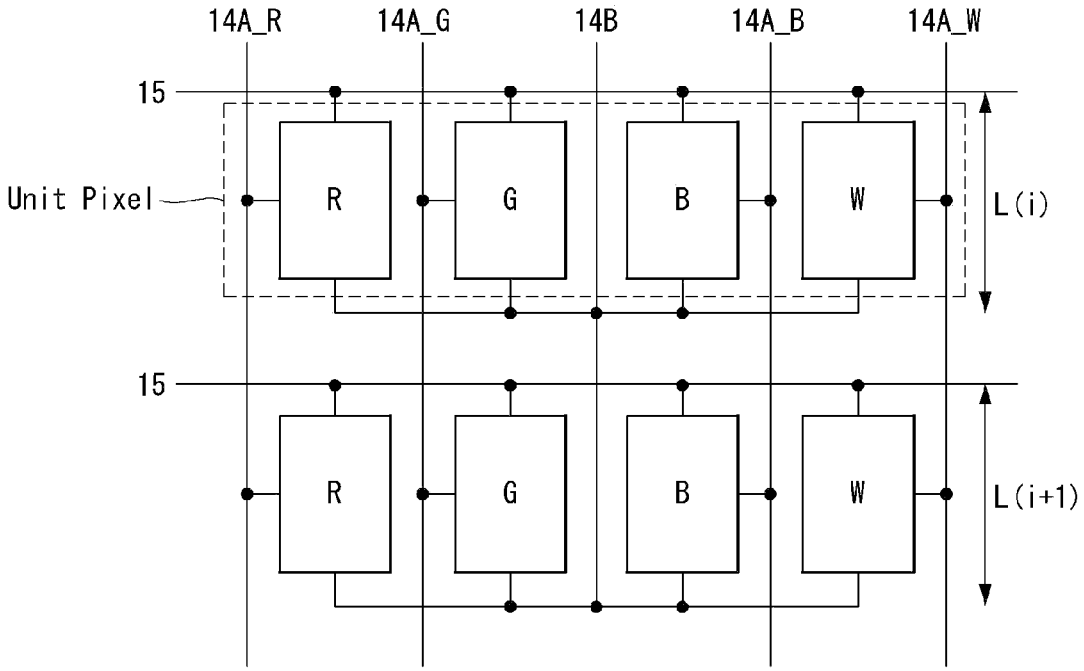
FIGS. 8 and 9 are view illustrating a pixel connection and a sense driving sequence according to a comparative example, respectively.
Figure 9:
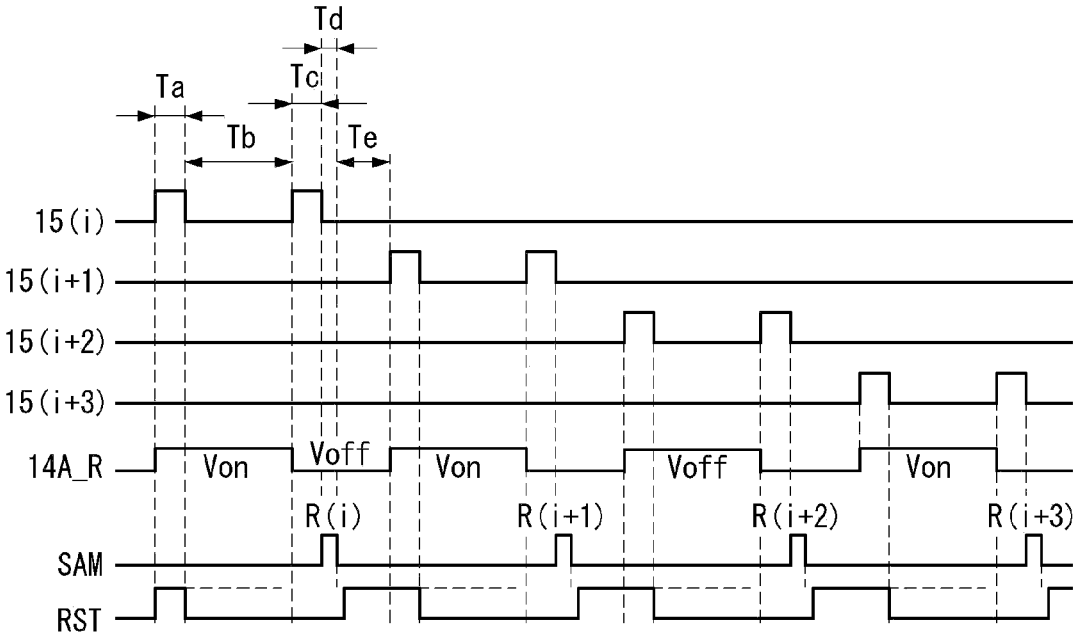
Figure 10:
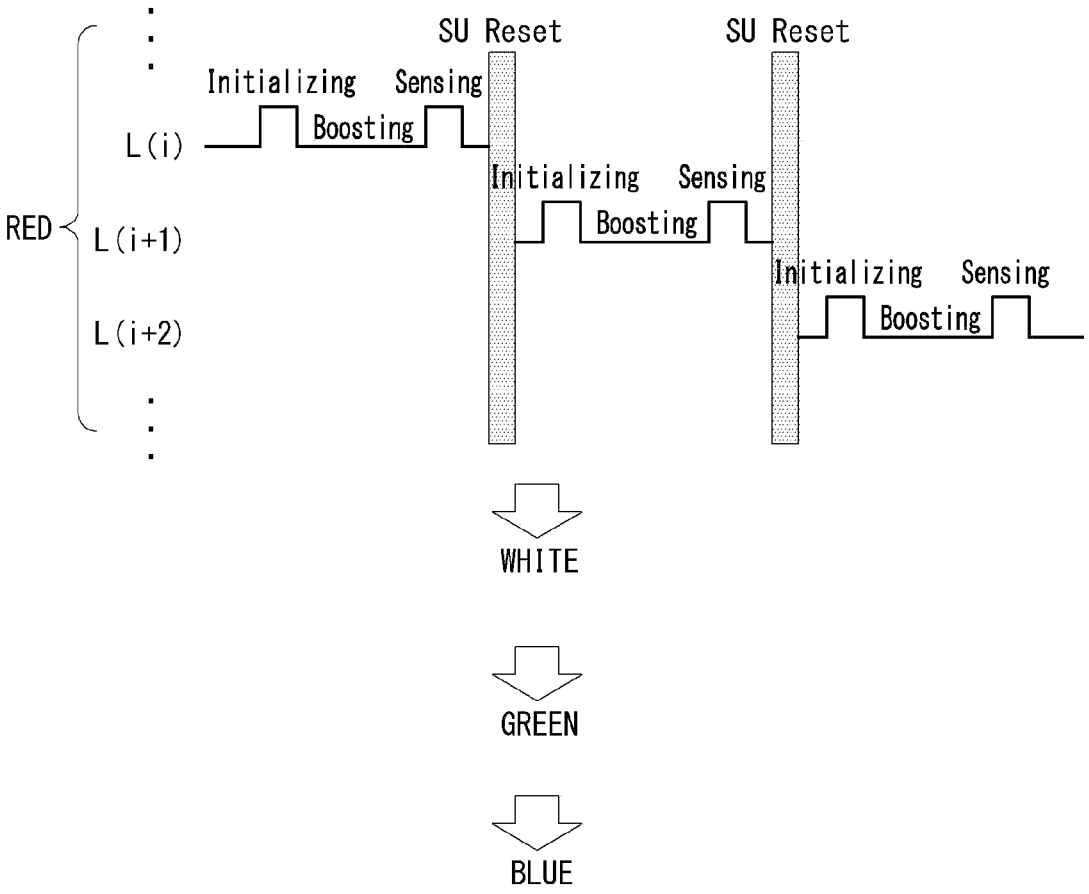
FIG. 10 is a view schematically illustrating a process of sequentially performing the sense driving sequence of FIG. 9 on sub-pixels of each color.

FIGS. 8 and 9 are view illustrating a pixel connection and a sense driving sequence according to a comparative example, respectively. FIG. 10 is a view schematically illustrating a process of sequentially performing the sense driving sequence of FIG. 9 on sub-pixels of each color.

In FIG. 8, RGBW sub-pixels constituting a unit pixel are connected to data lines 14A different from each other and connected to the same sensing line 14B and the same gate line 15.

For example, when sensing parasitic capacitance of the OLEDs included in R sub-pixels disposed on the display panel 10, as shown in FIG. 9, the data line 14A, the gate line 15, and the sensing line 14B are driven in the order of the initialization period Ta, the boosting period Tb, the integration period Tc, and the sampling period Td according to the sensing scan signal described with reference to FIG. 7 with respect to R sub-pixels arranged on the i-th display line, so that after the sensing operation for the R sub-pixels arranged on the i-th display line is completed, the sensing operation is started for R sub-pixels arranged on the (i+1)-th display line, and then after the sensing operation of the R sub-pixels arranged on the (i+1)-th display line is completed, the sensing operation for R sub-pixels arranged on the (i+2)-th display line is initiated.

In FIG. 9, a reset period Te in which the reset switch RST included in the sensing unit SU is turned on to reset the sensing unit may be inserted between the sampling period Td of the i-th display line and the initialization period Ta of the (i+1)-th display line. When the initialization period Ta of the next display line proceeds before the sampling switch control signal SAM completely transitions to a turn-off level after the sampling period Td, the initialization voltage Vpre set at the output terminal of the amplifier AMP is input to the sampling capacitor Cs through the sampling switch SAM, whereby values sensed during the integration period Tc and the sampling period Td may be made meaningless.

In the reset period Te, the control signal RST of the reset switch may transition to a turn-on level after the control signal SAM of the sampling switch transitions to a turn off level.

That is, when sensing sub-pixels of the first color, sub-pixels of the first color in the i-th display line are sensed through the initialization period Ta, the boosting period Tb, the integration period Tc, the sampling period Td in the i-th display line, and then sub-pixels of the first color in the (i+1)-th display line, which is next display line, are sensed through the initialization period Ta, the boosting period Tb, the integration period Tc, the sampling period Td, and the reset period Te in the corresponding display line.

When performing the sensing operation for all colors in the display panel 10, as shown in FIG. 10, the sense driving is performed on all display lines of the display panel 10 for sub-pixels of the first color, for example, red color, the sense driving is performed on all display lines of the display panel 10 for sub-pixels of white color, and then the sense driving is also performed for sub-pixels of green color and blue color.

It takes about 1.68 msec for the sensing unit SU to sense a characteristic of one sub-pixel, and it takes about 0.24 msec for the analog-to-digital converter ADC to perform conversion, so that when the sensing are repeated 64 times for one sub-pixel, it takes about (1.68+0.24)×64=122.88 msec. In addition, since it takes 29.5 msec to communicate between the data driving circuit 12 and the timing controller 11, it takes (122.88+29.5)×4×4320=2,633 sec to sense all 4,320 display lines of an 8K display for all four colors. That is, it takes 44 minutes and 31 seconds to sense the characteristic (parasitic capacitance) of the OLEDs of four color sub-pixels in the 8K display panel.

Figure 11:
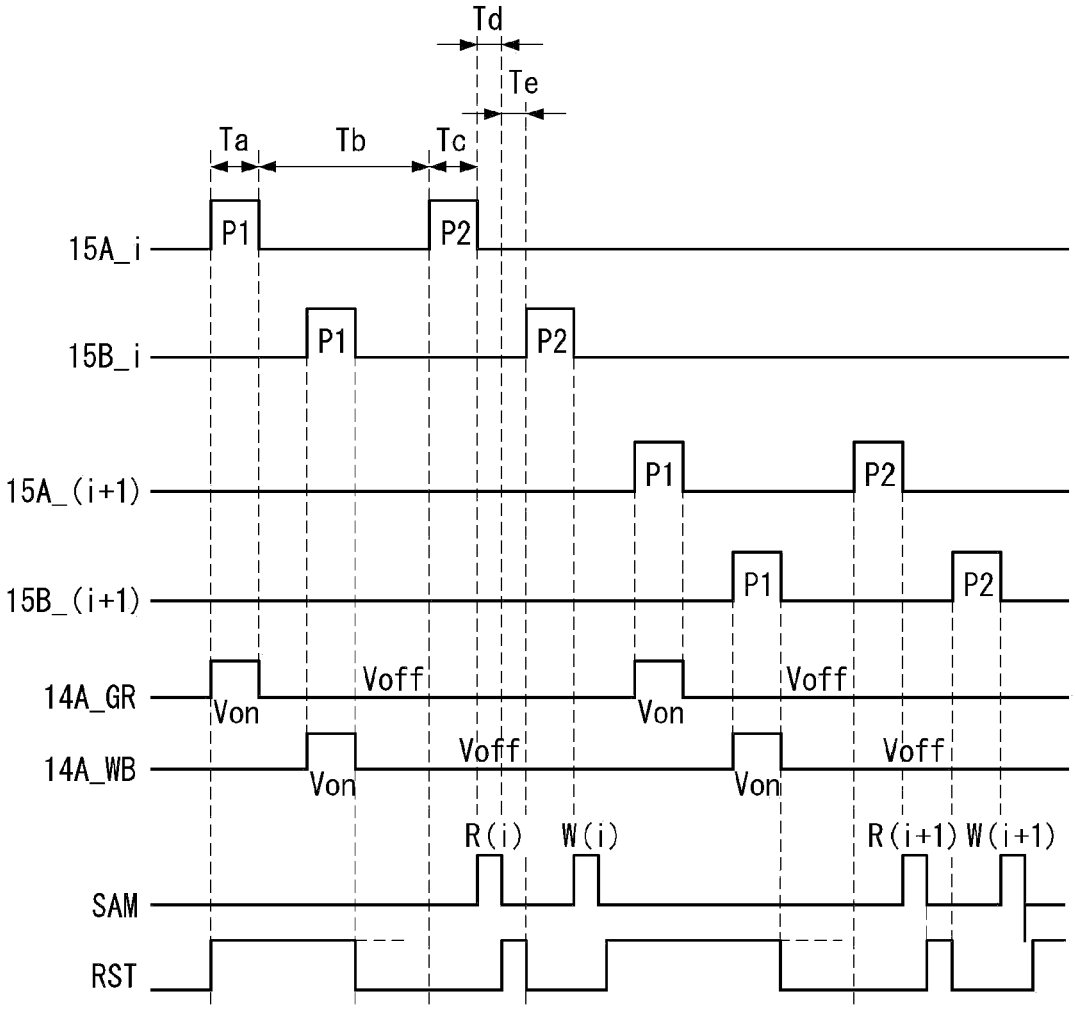
FIG. 11 is a view illustrating a sense driving sequence of detecting parasitic capacitances of OLEDs of two color sub-pixels in the pixel of FIG. 3A in an overlapping manner, according to an embodiment of the disclosure.
Figure 12:
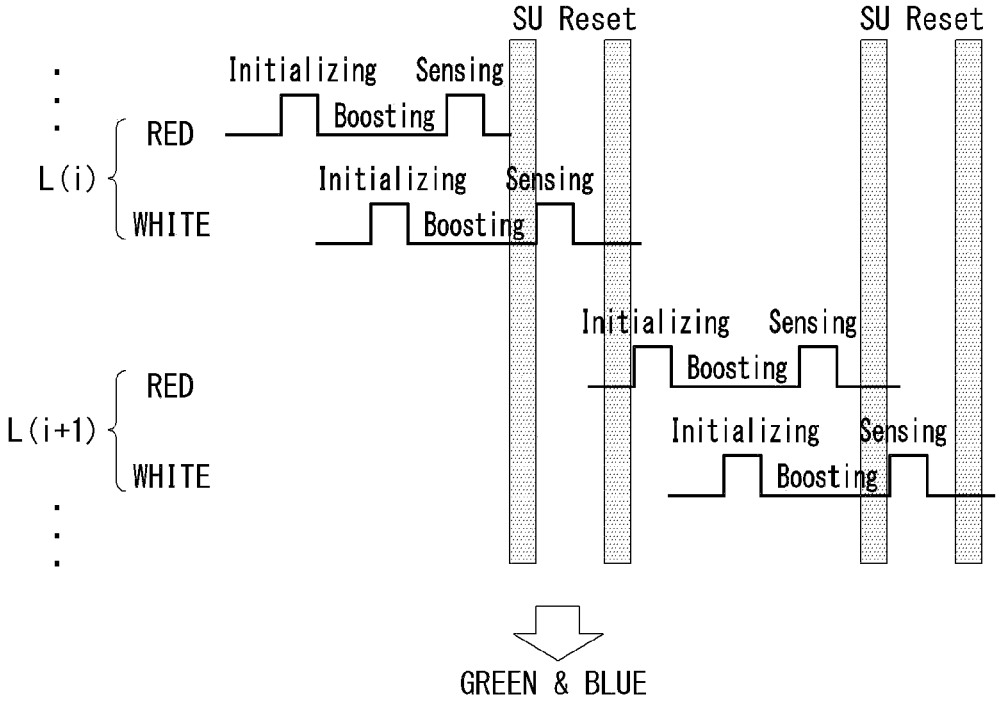
FIG. 12 is a view schematically illustrating a process of performing the sense driving sequence of FIG. 11 on four color sub-pixels, according to an embodiment of the disclosure.

FIG. 11 is a view illustrating a sense driving sequence of sensing parasitic capacitances of OLEDs of two color sub-pixels in the pixels of FIG. 3A in an overlapping manner, according to an embodiment of the disclosure. FIG. 12 is a view schematically illustrating a process of performing the sense driving sequence of FIG. 11 on four color sub-pixels, according to an embodiment of the disclosure In order to reduce the time required for sense driving in a DRD type pixel array, the sensing operation may be performed on sub-pixels of two different colors that do not share a data line within the same unit pixel at a predetermined time difference.

To this end, as shown in FIG. 11, when two sensing scan signals are output in an overlapping manner, the on-driving data voltage Von is supplied to the data line 14A only during which there is the first pulse P1, and the off-driving data voltage Voff is supplied to the data line 14A during the remaining period.

In FIG. 3A, the sensing operation may be performed for an R sub-pixel connected to the first data line 14A_GB and the first gate line 15A_i and a W sub-pixel connected to the second data line 14A_WB and the second gate line 15BA_i in an overlapping manner, among the sub-pixels of the unit pixel disposed on the i-th display line.

The second sensing scan signal SCAN supplied to the second gate line 15B_i may be delayed by a predetermined time interval from the first sensing scan signal SCAN supplied to the first gate line 15A_i. This is because the sampling period Td and the reset period Te during which the reset switch RST is turned on should be inserted between the second pulse P2 included in the first sensing scan signal SCAN and the second pulse P2 included in the second sensing scan signal SCAN.

That is, after the second pulse P2 of the first sensing scan signal SCAN, it is necessary that the sampling switch SAM is turned on to store the sensing voltage Vsen of the amplifier AMP corresponding to the parasitic capacitance of the OLED of the R sub-pixel in the sampling capacitor Cs, the sampling switch SAM is turned off to disconnect the current integrator CI and sampling capacitor Cs, and then the reset switch RST is turned on to reset (or initialize) the output voltage Vsen of the sensing line 14B and the amplifier AMP to the initialization voltage Vpre.

After resetting the sensing line 14B, a value corresponding to parasitic capacitance of the OLED of the W sub-pixel is set to the output voltage Vsen of the amplifier AMP by the second pulse P2 of the second sensing scan signal SCAN; the sampling switch SAM and the reset switch RST are controlled again to store the output voltage Vsen in the sampling capacitor Cs; and then the sensing line 14B is initialized to an initialization voltage Vpre.

Through this process, the sense driving is performed to sense the characteristics of OLEDs of R sub-pixel and W sub-pixel of the i-th display line, and then the sense driving is performed for R sub-pixel and W sub-pixel of the (i+1)-th display line.

When sensing the characteristics of R and W sub-pixels included in one display line, the second sensing scan signal for sensing the characteristics of W sub-pixel is delayed than the first sensing scan signal for sensing the characteristics of R sub-pixel by the integration period Tc corresponding to the second pulse P2, the sampling period Td for operating the sampling switch SAM, and the reset period Te for operating the reset switch RST, thereby reducing the time required for detecting the characteristics of two sub-pixels constituting the unit pixel.

When sensing sub-pixels of all colors in the display panel 10 in which the sub-pixels are arranged by the DRD method, as shown in FIG. 12, the sense driving is performed on sub-pixels of red color and white color in all display lines of the display panel 10, by performing sensing for sub-pixels of the first color and the second color, for example, red color and white color pixel, which are included in the same display line to compose a unit pixel and do not share the data line 14A, in an overlapping manner, and then the sense driving may be performed on all display lines of the display panel 10 by performing sensing for sub-pixels of the third color and the fourth color, for example, green and blue colors, which do not share the data line 14A, in an overlapping manner.

As in the example of FIG. 10, it takes about 1.68 msec for the sensing unit SU to sense the characteristic of one sub-pixel, and it takes about 0.24 msec for the analog-to-digital converter ADC to perform conversion. Since the analog-to-digital converter ADC converts sensing voltage into sensing data twice in a continuous manner, when the sensing is repeated 64 times for two sub-pixels, it takes about (1.68+0.24×2)×64=138.24 msec to detect the sensing data of two sub-pixels.

In addition, the time required for the communication between the data driving circuit 12 and the timing controller 11 is 29.5 msec as in the example of FIG. 10. It takes (138.24+29.5)×2×4320=1,449 sec to sense all 4,320 display lines of an 8K display for the other two colors. That is, it takes 22 minutes and 34 seconds to sense the parasitic capacitance characteristics of the OLEDs of four color sub-pixels in the 8K display panel, thereby reducing the time to about 45% compared to the comparative example of FIG. 10.

Meanwhile, when the boosting period Tb is sufficiently longer than the initialization period Ta, the integration period Tc, the sampling period Td, and the reset period Te so that three integration periods Tc, three sampling periods Td, and three reset periods Te are in one boosting period Tb, R and W sub-pixels included in two display lines may be simultaneously sensed. Herein, the sensing time can be further reduced compared to the embodiment of FIG. 12.

With respect to an embodiment of FIGS. 11 and 12, the sense driving is performed for two color sub-pixels in the i-th display line, and then the sense driving is performed for the same two color sub-pixels in the (i+1)-th display line.

However, when performing the sense driving, since the OLED of the sub-pixel which is the target of sense driving emits light, it is easy for a user to perceive that the display line is continuously turned on. Accordingly, it is possible to perform the sense driving while arbitrarily changing the display line.

Figure 13:
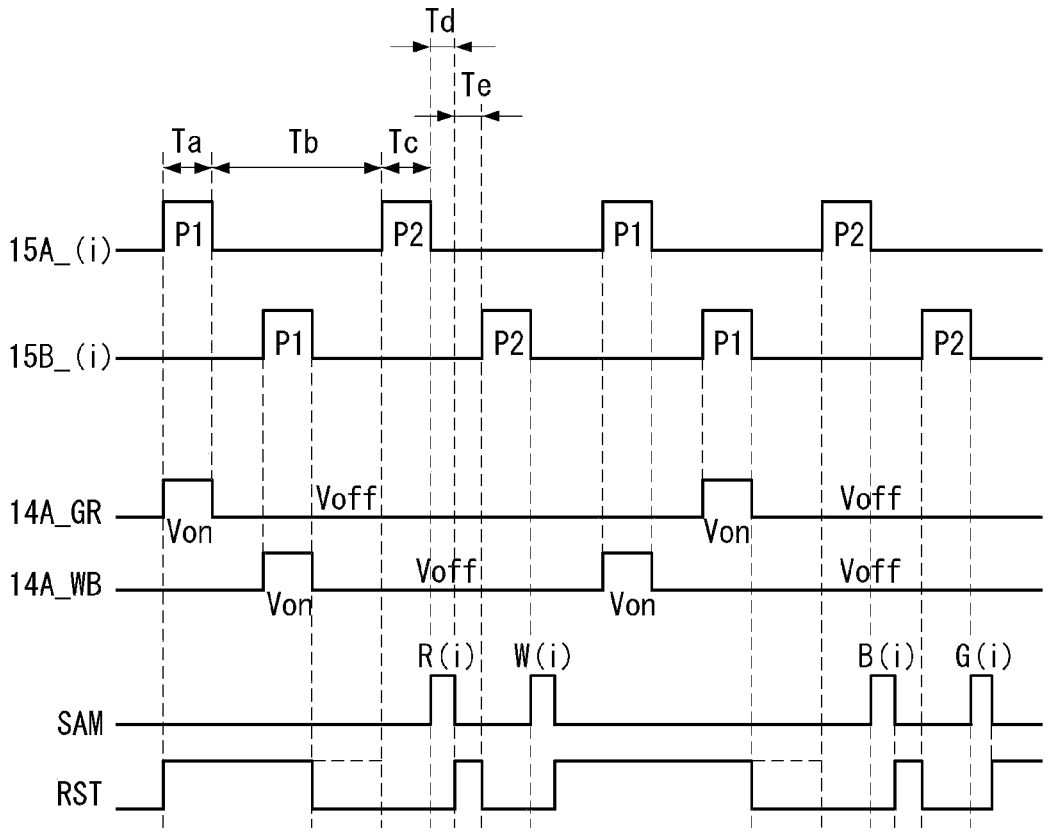
FIG. 13 is a view illustrating a sense driving sequence of continuously sensing sub-pixels of all colors in one display line when detecting parasitic capacitances of OLEDs of two color sub-pixels in the pixel of FIG. 3A, according to an embodiment of the disclosure.

FIG. 13 is a view illustrating a sense driving sequence of sensing parasitic capacitances of OLEDs of two-color sub-pixels in an overlapping manner and continuously sensing all color sub-pixels in one display line in the pixel of FIG. 3A, according to an embodiment of the disclosure.

In an embodiment of FIG. 12, the sense driving is performed for sub-pixels of two colors, that is, R and W colors in the i-th display line, and then the sense driving is performed for sub-pixels of R and W colors in (i+1)-th display line, which is the next display line.

In FIG. 13, unlike in FIG. 12, the sense driving is performed for sub-pixels of red and white colors in the i-th display line, and then the sense driving is performed for sub-pixels of blue and green colors, which are the other two colors, in the i-th display line, without changing the display line.

A first sensing scan signal is supplied to the first gate line 15A_i in the i-th display line, and on and off-driving data voltages Von and Voff are supplied to the first data line 14A_RG in synchronization with this, thereby detecting sensing data R(i) of red color of the i-th display line. In addition, a second sensing scan signal is supplied to the second gate line 15B_i in the i-th display line, later than the first sensing scan signal by the integration period Tc, the sampling period Td, and the reset period Te, and on and off-driving data voltages Von and Voff are supplied to the second data lines 14A_WB in synchronization with this, thereby detecting sensing data W(i) of W color in the i-th display line.

Thereafter, the first sensing scan signal is supplied again to the first gate line 15A_i of the i-th display line, later than the second sensing scan signal by the integration period Tc, the sampling period Td, and the reset period Te, and on and off-driving data voltages Von and Voff are supplied to the second data line 14A_WB in synchronization with this, thereby detecting sensing data B(i) of blue color in the i-th display line. In addition, the second sensing scan signal is supplied to the second gate line 15B_i of the i-th display line, later than the first sensing scan signal by the integration period Tc, the sampling period Td, and the reset period Te, and on and off-driving data voltages Von and Voff are supplied to the first data line 14A_GR in synchronization with this, thereby detecting sensing data G(i) of green color in the i-th display line.

As shown in FIG. 13, the first sensing scan signal and the second sensing scan signal are sequentially supplied twice to the first and second gate lines 15A_i and 15B_i connected to sub-pixels in one display line (i-th display line), and on and off-driving data voltages Von and Voff are supplied to the first and second data lines 14A_GR and 14A_WB, in synchronization with this, thereby sensing the characteristics (parasitic capacitance of OLED) of OLEDs of all color sub-pixels in one display line.

According to the embodiment of FIG. 13, it is possible to sense the characteristics of sub-pixels included in the display panel 10, that is, parasitic capacitance of OLEDs included in the sub-pixels, with less time, compared to the comparative example of FIGS. 9 and 10.

Accordingly, in a DRD pixel structure in which two neighboring sub-pixels share a data line and are connected to different gate lines from each other, the sensing scan signal is supplied to two sub-pixels arranged on the same display line and sharing the data line at a predetermined time interval, in an overlapping manner, thereby simultaneously sensing the characteristics of two sub-pixels at a short time.

The display device described in the specification can be described as follows.

A display device according to an embodiment includes a display panel including a plurality of unit pixels having at least two sub-pixels that share a data line and are connected to different gate lines, a driving circuit supplying a scan signal and a data voltage to a first sub-pixel and a second sub-pixel included in a unit pixel of the plurality of unit pixels and connected to different data lines, a sensing unit connected to the first sub-pixel and the second sub-pixel through a sensing line to sense operating characteristics of the first sub-pixel and the second sub-pixel, and a timing controller controlling the driving circuit and the sensing unit to obtain sensing data corresponding to the operating characteristics and compensate the data voltage based on the sensing data, wherein the timing controller controls the driving circuit and the sensing unit so that a first sensing scan signal for sensing the operating characteristics of the first sub-pixel and a second sensing scan signal for sensing the operating characteristics of the second sub-pixel are supplied in a partially overlapping manner to sequentially obtain first sensing data and second sensing data corresponding to the operating characteristics of the first sub-pixel and the second sub-pixel.

According to an embodiment, each of the first sensing scan signal and the second sensing scan signals may be composed of a turn-on level in a first period, a turn-off level in a second period after the first period, a turn-on level in a third period after the second period, and a turn-off level in a fourth period after the third period, and the fourth period of the first sensing scan signal may precede the third period of the second sensing scan signal.

According to an embodiment, the first period may be an initialization period in which a pixel current flowing in a driving element included in each of the first sub-pixel and the second sub-pixel is set, the second period may be a boosting period in which charge according to the pixel current is stored in a parasitic capacitor of a light emitting element included in each of the first sub-pixel and the second sub-pixel, the third period may be an integration period in which charge stored in the parasitic capacitor is integrated to generate a sensing voltage, and the fourth period may be a sampling period in which the sensing voltage is sampled.

According to an embodiment, the driving circuit may supply an on-driving data voltage, which is to turn on the driving element in the first sb-pixel and the second sub-pixel, to a gate electrode of the driving element through the data line in the first period, and supply an off-driving data voltage, which is to turn off the driving element in the first sub-pixel and the second sub-pixel, to the gate electrode of the driving element through the data line in the second period, third period, and the fourth period.

According to an embodiment, the timing controller may reset the sensing unit between the fourth period of the first sensing scan signal and the third period of the second sensing scan signal.

According to an embodiment, the first period of the second sensing scan signal may be later than the first period of the first sensing scan signal by at least a sum of the third period, the fourth period, and a fifth period during which the sensing unit is reset.

According to an embodiment, the timing controller may control the driving circuit and the sensing unit, so that the first sensing scan signal and the second sensing scan signal are supplied to the first sub-pixel and the second sub-pixel in an i-th (i is a natural number) display line, in an overlapping manner, thereby sequentially obtaining the first sensing data and the second sensing data in the i-th display line, and the first sensing scan signal and the second sensing scan signal are supplied to another first sub-pixel and another second sub-pixels of an m-th (m is a natural number) display line other than the i-th display line, in an overlapping manner, thereby sequentially obtaining first and second sensing data of the m-th display line, and the first period of the first sensing scan signal supplied to the first sub-pixel in the m-th display line is later than the fourth period of the second sensing scan signal supplied to the second sub-pixel of the i-th display line by at least the fifth period.

According to an embodiment, the unit pixel may further include a third sub-pixel and a fourth sub-pixel connected to different data lines and different gate lines; the timing controller may control the driving circuit and the sensing unit, so that the first sensing scan signal and the second sensing scan signal are supplied to the first sub-pixel and the second sub-pixels of an i-th (i is a natural number) display line in a partial overlapping manner to sequentially obtain the first sensing data and the second sensing data of the i-th display line, and a third sensing scan signal and a fourth sensing scan signal having the same shape as the first sensing scan signal and the second sensing scan signal are supplied to a third sub-pixel and a fourth sub-pixel of the i-th display line in a partial overlapping manner, to sequentially obtain third sensing data and fourth sensing data corresponding to operating characteristics of the third sub-pixel and the fourth sub-pixels of the i-th display line, and the first period of the third sensing scan signal may be later than the fourth period of the second sensing scan signal by at least the fifth period.

According to an embodiment, the first sub-pixel and the third sub-pixel may share a first data line, the second sub-pixel and the fourth sub-pixel share a second data line, the first sub-pixel and the fourth sub-pixel are connected to a first gate line, the second sub-pixel and the third sub-pixel are connected to a second gate line, light emitting units and circuit units of the first sub-pixel, second sub-pixel, the third sub-pixel, and the fourth sub-pixels may be alternately arranged, and the first sub-pixel, the second sub-pixel, the third sub-pixel, and the fourth sub-pixels may be commonly connected to the sensing line.

According to an embodiment, the first sub-pixel, the second sub-pixel, the third sub-pixel, and the fourth sub-pixels may be a red sub-pixel, a white sub-pixel, a green sub-pixel, and a blue sub-pixel, respectively.

According to an embodiment, the operating characteristic of the sub-pixel may be parasitic capacitance of a capacitor in a light emitting element included in the sub-pixel.

Through the above description, those skilled in the art will appreciate that various changes and modifications are possible without departing from the technical spirit of the present disclosure. Therefore, the technical scope of the present disclosure is not limited to the contents described in the detailed description of the specification, but should be determined by the scope of the claims.

What is claimed is:

1. A display device, comprising:

a display panel including a plurality of unit pixels having at least two sub-pixels that are connected to a same data line and are connected to different gate lines;

a driving circuit supplying a scan signal and a data voltage to a first sub-pixel and a second sub-pixel included in a unit pixel of the plurality of unit pixels and connected to different data lines;

a sensing circuit connected to the first sub-pixel and the second sub-pixel through a sensing line to sense operating characteristics of the first sub-pixel and the second sub-pixel; and a timing controller controlling the driving circuit and the sensing circuit to obtain sensing data corresponding to the operating characteristics and compensate the data voltage based on the sensing data, wherein the timing controller controls the driving circuit and the sensing circuit to supply a first sensing scan signal for sensing the operating characteristics of the first sub-pixel and a second sensing scan signal for sensing the operating characteristics of the second sub-pixel in a partially overlapping manner, and sequentially obtains first sensing data and second sensing data corresponding to the operating characteristics of the first sub-pixel and the second sub-pixel, wherein each of the first sensing scan signal and the second sensing scan signal is composed of a turn-on level in a first period, a turn-off level in a second period after the first period, a turn-on level in a third period after the second period, and a turn-off level in a fourth period after the third period, and wherein the fourth period of the first sensing scan signal precedes the third period of the second sensing scan signal.

2. The display device of claim 1, wherein the operating characteristic of a sub-pixel of the at least two sub-pixels is parasitic capacitance of a capacitor in a light emitting element included in the sub-pixel.

3. The display device of claim 1, wherein the first period is an initialization period in which a pixel current flowing in a driving element included in each of the first sub-pixel and the second sub-pixel is set, the second period is a boosting period in which charge according to the pixel current is stored in a parasitic capacitor of a light emitting element included in each of the first sub-pixel and the second sub-pixel, the third period is an integration period in which charge stored in the parasitic capacitor is integrated to generate a sensing voltage, and the fourth period is a sampling period in which the sensing voltage is sampled.

4. The display device of claim 3, wherein the driving circuit supplies an on-driving data voltage, which is to turn on the driving element in the first sub-pixel and the second sub-pixel, to a gate electrode of the driving element through the data line in the first period, and supplies an off-driving data voltage, which is to turn off the driving element in the first sub-pixel and the second sub-pixel, to the gate electrode of the driving element through the data line in the second period, the third period, and the fourth period.

5. The display device of claim 1, wherein the timing controller resets the sensing circuit between the fourth period of the first sensing scan signal and the third period of the second sensing scan signal.

6. The display device of claim 5, wherein the first period of the second sensing scan signal is later than the first period of the first sensing scan signal by at least a sum of the third period, the fourth period, and a fifth period during which the sensing circuit is reset.

7. The display device of claim 6, wherein the timing controller controls the driving circuit and the sensing circuit, so that the first sensing scan signal and the second sensing scan signal are supplied to the first sub-pixel and the second sub-pixel in an i-th (i is a natural number) display line, in an overlapping manner, thereby sequentially obtaining the first sensing data and the second sensing data in the i-th display line, and the first sensing scan signal and the second sensing scan signal are supplied to another first sub-pixel and another second sub-pixel of an m-th (m is a natural number) display line different from the i-th display line, in an overlapping manner, thereby sequentially obtaining another first sensing data and another second sensing data of the m-th display line; and the first period of the first sensing scan signal supplied to the first sub-pixel in the m-th display line is later than the fourth period of the second sensing scan signal supplied to the second sub-pixel of the i-th display line by at least the fifth period.

8. The display device of claim 6, wherein the unit pixel further includes a third sub-pixel and a fourth sub-pixel connected to different data lines and different gate lines;

the timing controller controls the driving circuit and the sensing circuit, so that the first sensing scan signal and the second sensing scan signal are supplied to the first sub-pixel and the second sub-pixel of an i-th (i is a natural number) display line in a partial overlapping manner to sequentially obtain the first sensing data and the second sensing data of the i-th display line, and a third sensing scan signal and a fourth sensing scan signal having the same shape as the first sensing scan signal and the second sensing scan signal are supplied to a third sub-pixel and a fourth sub-pixel of the i-th display line in a partial overlapping manner, to sequentially obtain third sensing data and fourth sensing data corresponding to operating characteristics of the third sub-pixel and the fourth sub-pixels of the i-th display line, and the first period of the third sensing scan signal is later than the fourth period of the second sensing scan signal by at least the fifth period.

9. The display device of claim 8, wherein the first sub-pixel and the third sub-pixel share a first data line, the second sub-pixel and the fourth sub-pixel share a second data line, the first sub-pixel and the fourth sub-pixel are connected to a first gate line, the second sub-pixel and the third sub-pixel are connected to a second gate line;

light emitting areas and circuit areas of the first sub-pixel, the second sub-pixel, the third sub-pixel, and the fourth sub-pixel are alternately arranged; and the first sub-pixel, the second sub-pixel, the third sub-pixel, and the fourth sub-pixel are commonly connected to the sensing line.

10. The display device of claim 9, wherein the first sub-pixel, the second sub-pixel, the third sub-pixel, and the fourth sub-pixel are a red sub-pixel, a white sub-pixel, a green sub-pixel, and a blue sub-pixels, respectively.

* * * * *